United States Patent [19]

Katz

[11] Patent Number: 4,970,951

[45] Date of Patent: Nov. 20, 1990

[54] CAN CRUSHING APPARATUS

[76] Inventor: Philip R. Katz, 734 Ridge Road Ter., Kinnelon, N.J. 07045

[21] Appl. No.: 340,849

[22] Filed: Apr. 20, 1989

Related U.S. Application Data

[63] Continuation-in-part of Ser. No. 174,604, Mar. 30, 1988, abandoned.

[51] Int. Cl.[5] ..... B30B 1/18

[52] U.S. Cl. ..... 100/289; 100/98 R; 100/295; 100/902

[58] Field of Search ..... 100/902, 295, 289, 280, 100/231, 98 R, 214

[56] References Cited

U.S. PATENT DOCUMENTS

| | | | |
|---|---|---|---|
| D. 266,566 | 10/1982 | Schmid | 100/902 X |
| 2,408,312 | 9/1946 | Hubbert | 100/231 X |
| 3,208,372 | 9/1965 | Taylor | 100/214 X |
| 4,133,261 | 1/1979 | Belfils | 100/902 X |
| 4,143,595 | 3/1979 | Carlson | 100/902 X |
| 4,213,387 | 7/1980 | McCaney et al. | 100/902 X |
| 4,387,637 | 6/1983 | Baird | 100/902 X |

FOREIGN PATENT DOCUMENTS

| | | | |
|---|---|---|---|
| 145861 | 3/1952 | Australia | 100/289 |
| 110 | 9/1863 | Italy | 100/289 |
| 1156139 | 6/1969 | United Kingdom | 100/902 |

*Primary Examiner*—Timothy F. Simone

*Assistant Examiner*—Stephen F. Gerrity

*Attorney, Agent, or Firm*—Robert D. Farkas

[57] ABSTRACT

An electrically actuated can crushing apparatus having a housing, a reversible motor mounted within the housing, a threaded shaft coupled for rotation with the output shaft of the motor, and an arm threadingly engaged to the threaded shaft. An antirotation device prohibits the arm from rotation thus permitting the arm to move upwardly and downwardly, dependent upon the direction of rotation of the threaded shaft. An uppermost pressure plate is secured to the arm at an angle skewed to the longitudial axis of the vertically disposed threaded shaft. The housing supports a lowermost pressure plate which is affixed in a horizontal plane and is adapted with an upwardly directed protrusion to accommodate the depression usually found in the base of cans to be crushed. Upon the actuation of the motor, the uppermost pressure plate, which is constantly maintained at a slight angular relationship with the longitudinal axis of the threaded shaft, approaches the lowermost pressure plate. Protusions disposed at selected locations extend downwardly from a lower surface of the uppermost plate and deform the can at the beginning of the can crushing operation. Upon the completion of crushing operation, the uppermost pressure plate returns to its uppermost position at which time the can may be removed from the apparatus preparatory to repeated operations.

1 Claim, 4 Drawing Sheets

CAN CRUSHING APPARATUS

This application is a Continuation-in-part of application Ser. No. 07/174,604, filed Mar. 30, 1988 (now abandoned).

BACKGROUND OF THE INVENTION

1. Field of the Invention

This invention relates to can crushing devices and more particularly to an improved can crushing apparatus which is electrically operated and capable of inexpensively crushing commercial beverage cans or the like of various sizes in a neat small form and in a quick, efficient and uniform manner.

2. Description of the Prior Art

Beverage cans such as aluminum and steel soda cans have been a continuing problem in today's ecology minded society. The wide number of beverages utilizing such form of cans creates the problem in which the cans after use must often times be separated so that they can be brought to a recycling center. Prior to bring it to the center, the volume or space consumed by such cans is substantial. Therefore, it is highly desirous to store such cans in a crushed or reduced compacted state so as to minimize volume storage requirements. It is also desirable to crush cans in such a manner that the crushed cans do not have exposed sharp edges.

Since many cans in the process of being disposed of contain a small residuum of liquid, vertically crushing them appears to be more desirable than crushing cans whose longitudinal axes are disposed in a horizontal dimention. However, when attempting to crush vertically disposed cans, the amount of force required to crush the can is extremely great, due to the inherent structure of the can to be crushed. The can itself in the topmost and lowermost regions are reinforced in strength by the forming of the can or the placement of the can lid. The weakest part of the can is usually the side of the can which is amenable to lower level inwardly directed pressures, directed inwardly towards the vertical axis of the can. Somewhat more force is required to deform either the uppermost or lowermost lateral surfaces of the can, but considerably less force is required than the amount of force required to compress a can which is not so deformed.

In a patent to Belfils, U.S. Pat. No. 4,133,261, a device is disclosed which requires considerable force to crush a can. In Belfils, the crusher has a base on which the can to be crushed is placed and means for crimping one side of the can when pressure is applied to the top of the can is provided. The crimping is accomplished by a bead on the bottom base. Since the crimping means is provided by a bead, cans of varying sizes require different crushing pressures. Since the cans are not restrained in Belfils, they can buckle into a wide variety of shapes and may be forcibly ejected during crushing, resulting in the injuries to the user.

In a patent to Dodd, U.S. Pat. No. 4,570,536, issued Feb. 18, 1986, an electrically actuated can crusher is disclosed, which simply applies a constant uniform force to the uppermost region of the can, whilst the bottommost region of the can is resting on a lowermost crush plate. Here, the crushing force required to crush a can is substantial and would require a motor of great size to crush cans of various strengths and thicknesses.

U.S. Pat. No. 4,358,994 to Talley, issued Nov. 16, 1982, teaches the application of a force to a can, directed inwardly on one side of the can, causing the can to bend almost in half, followed by an operation to flatten or compress the balance of the can into a relatively thin laminate. However, the Talley teaching describes a two step operation, in order to accomplish the preweakening of the can.

U.S. Pat. No. 3,889,587 to Wharton, issued June 17, 1975 discloses an apparatus which slits at least one side of the can, prior to a compression step. Here, the can is contained within a housing which prohibits the can from extending outwardly forcing the cut edges of the can to collapse inwardly.

U.S. Pat. No. 4,301,722 issued to Balbo et al on Nov. 24, 1981, teaches an apparatus having an opening through which the can is inserted prior to the crushing operation. Such opening deforms the sides of the can, as it is manually placed within the housing, followed by a crushing step wherein the moveable crushing plate is directed manually towards the stationary crushing plate.

U.S. Pat. No. 4,333,396 to Longnecker issued June 8, 1982 describes a two stage can crushing device in which a linkage is adapted to partially deform of the can, followed by a step in which the can is moved to a second can crushing head which completes the crushing operation. The protrusion, mounted in an offset manner to the center of the first movable crushing plate, applies a force to the can so as to deform the uppermost surface in an asymmetrical fashion permitting the can to be more easily crushed during the second stage of crushing operation.

U.S. Pat. No. 4,290,354, to Stevens, issued Sept. 22, 1981, teaches a manually operated beverage can crusher having affixed to the lowermost stationary crusher plate a pivotable plate upon which the can, prior to crushing, is rested. At the conclusion of the crushing operation, the movable plate may be pivoted so as to eject the crushed can from the confines of the housing to which it is contained.

International Patent Publication No. WO 81/02802, published Oct. 1, 1981, under the Patent Cooperation Treaty to Andersson, et al. teaches a can crushing apparatus having an upper pressure plate forceably downward directed, and having an elongated protrusion extending below its lowermost lateral surface for uniform operation upon the uppermost lateral surface of the can to be crushed. In another embodiment, the same inventors teach the lowermost pressure plates having two upwardly extending protrusions upon which the base of the can to be crushed is placed, whilst the uppermost surface of the can to be crushed is uniformly deformed by the single projection extending downwardly from the uppermost pressure plate.

There is thus a need for a can crushing apparatus which crushes a can vertically with a minimal amount of required force so as to produce a compacted can without exposed sharp edges, symmetrical in appearance, requiring the use of modest forces to crush the can.

SUMMARY OF THE INVENTION

It is an object of this invention to provide a can crushing apparatus which crushes a can vertically with a minimum amount of desired force which is produced electrically.

It is a further object of this invention to provide a can crushing apparatus which crushes a can in one smooth continuous operation without any preliminary separate steps of deforming or slitting the can, thus minimizing the amount of effort required for each crushing operation.

Another object is to provide a can crushing apparatus where the can can be disposed within the housing of vending machines or disposed in a separate appliance dedicated specifically for the purpose of crushing cans inexpensively and efficiently.

Still another object is to provide an electric can crushing apparatus which is small, compact, and easy enough to use such as to constitute a household appliance of inexpensive cost.

It is yet another object of the present invention to provide an apparatus in which the uppermost movable pressure plate moves downward in a continuous smooth motion as it engages the upper lateral surface of the can to be crushed, resulting in a deformation of the can during the initial movement of the uppermost movable pressure plate.

These and other objects are accomplished by providing an electrically actuated can crushing apparatus having a housing, a reversible motor mounted within the housing, the motor having an output shaft. The output shaft is coupled to a threaded shaft or screw which is rotated when the output shaft rotates. The threaded shaft is disposed having its longitudinal axis in a vertical direction. An uppermost pressure plate is secured to an arm. The arm contains a threaded opening threadingly engaged to the threaded shaft or screw. An antirotation device in the form of a vertically disposed plate is provided so that the arm only moves upwardly and downwardly, depending upon the direction of rotation of the motor which disposes the uppermost pressure plate in an upward or downward direction. The housing also includes a lowermost stationary plate which is configured with a disc-like protrusion to correspond with the depression usually found within the base of cans to be crushed. The can is placed on the lowermost pressure plate prior to the can crushing operation. The can is then totally within the housing. The housing includes an access door which in the open position permits ready access for the can to be crushed to be placed resting upon the lowermost pressure plate. After the can crushing operation, the crushed can may be removed upon opening up the door. The electric motor is operated upon the manual activation of a switch which compels the uppermost pressure plate to descend from its normal rest position disposed furthest away from the lowermost pressure plate. When the uppermost pressure plate and associated arm reach its lowermost position, a micro switch is activated causing the motor to reverse its direction and to bring the uppermost pressure plate back up towards its rest position. When the uppermost pressure plate is in its rest position another micro switch detects such location and causes the motor to cease rotating. The lowermost lateral surface of the uppermost pressure plate contains a round recess, which recess is configured to have residing therein a number of downwardly projecting protrusions. Some of the protrusions are of differing heights and widths than the rest of the protrusions. Each of such protrusions are directed radially outwardly from the center of the recess and extend to the periphery thereof. In the embodiment utilizing six protrusions, two of such protrusions have a greater height and are somewhat thicker than the remaining four protrusions. The uppermost pressure plate is configured to have one end thereof disposed adjacent the door and is permanently maintained in a tilted position with this end somewhat lower than the rear portion of the uppermost pressure plate regardless of the position of the uppermost pressure plate. If desired, the base of the recess in the uppermost pressure plate may be maintained parallel at all times to the lowermost pressure plate, in which case the desired effect may be achieved by relying solely on the differing heights of the protrusions. Thus, in either case, the protrusion located closest to the frontmost region of the uppermost pressure plate first contacts the edge of the uppermost lateral surface of the can to be crushed. Then, the next protrusion, coaxially aligned with the first mentioned protrusion, contacts the uppermost lateral surface of the can to be crushed. This second mentioned protrusion to contact the can is of a greater height than the other protrusions yet to contact the can. This second mentioned protrusion extends running towards the rearmost portion of the uppermost pressure plate. In the embodiment where six protrusions are employed in total, after the first mentioned protrusion and the second mentioned protrusion contact the edge of the can, the remaining four protrusions, in pairs, contact the edge of the uppermost lateral surface of the can to be crushed in sequential realtionship so as to weaken the uppermost lateral surface of the can and thereby destroy the integrity or strength of the can, permitting a smaller motor to crush the balance of the can with relative ease and convenience. Since the uppermost pressure plate is skew to the lowermost pressure plate, force is applied to the can firstly at one point and then in time to the balance of the top of the can at two locations in opposite diameters about the periphery of the can until the entire force produced by the motor is applied to the top of the can, radially opposite from the point which first was contacted by the skewed uppermost pressure plate.

DESCRIPTION OF THE PREFERRED EMBODIMENT

Figure 1:
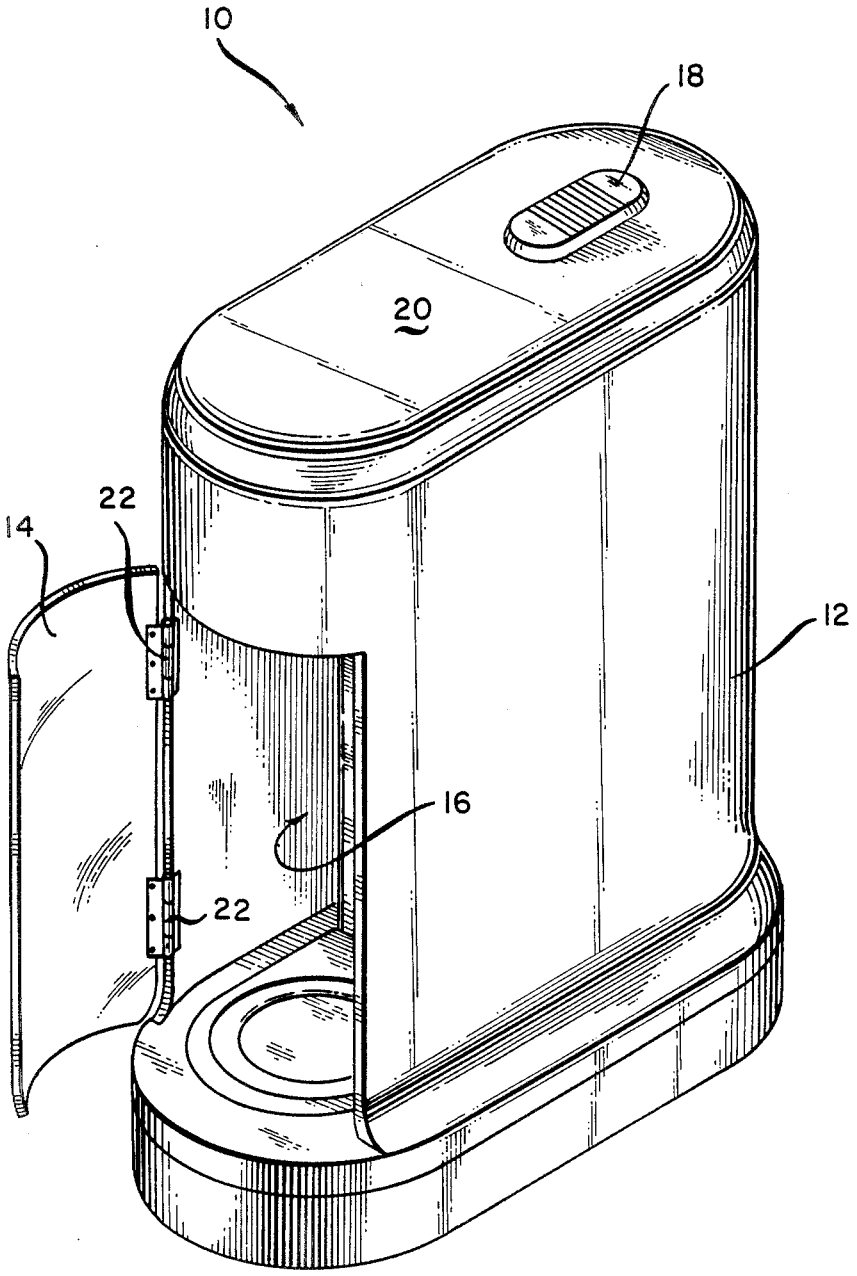
FIG. 1 is a perspective view of the present invention.

Now referring to the drawings, FIG. 1 shows can crusher apparatus 10 disclosed utilizing housing 12. Door 14 is pivotably secured to housing 12 and exposes opening 16 when opened. Switch mechanism 18 is mounted on the uppermost lateral surface 20 of housing 12, whose function will be described later. Hinges 22 secure door 14 to housing 12.

Figure 2:
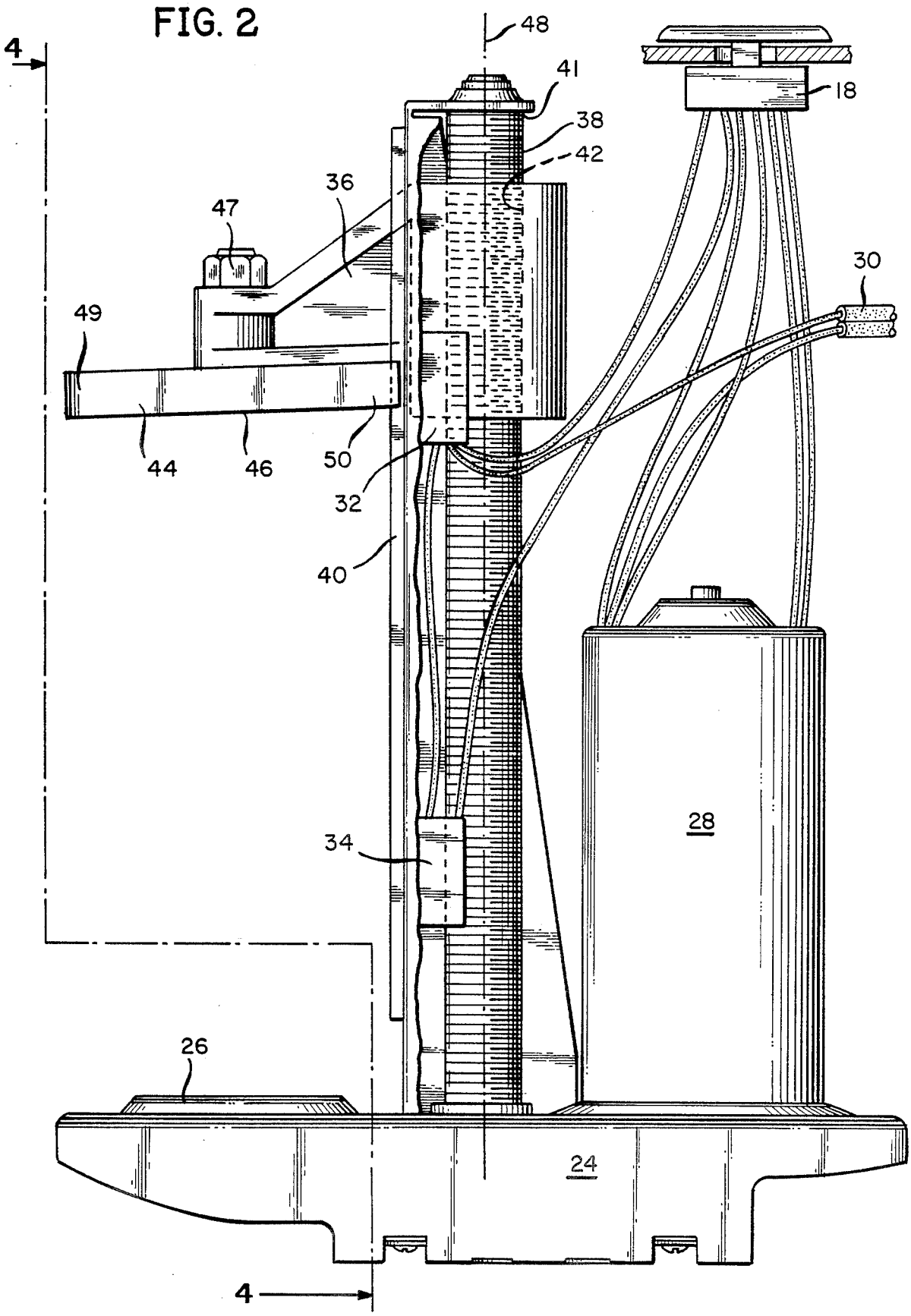
FIG. 2 is a side elevation view of the present invention with the housing and base cover removed.

FIG. 2 illustrates the internal mechanism of the apparatus 10, as shown in FIG. 1, when housing 12 is removed. Base 24 is adapted with a circular-like protrusion 26 whose outermost diameter is configured to reside within the recess normally found in the base of cans of the type to be crushed. Motor 28 is electrically operated utilizing cable 30 and switch 18 therefor, as shown in FIG. 1. Household current is provided to the apparatus through conventional means well known in the art such that when switch 18 is disposed in an operating position, motor 28 begins it's rotation and will rotate in one direction until a selected time, at which time it will reverse it's direction, and with the aid of micro switch 32, cease rotation. Micro switch 34, detects the position of arm 36 at its downwardmost position and causes the reverse rotation of motor 28 in a manner well known in the art. Elongated threaded shaft 38 is coupled for rotation with the output shaft, not shown, of motor 28. Plate 40 is secured to base 24 and is immoveable. Arm 36 is adapted with a threaded hole 42 for threaded engagement with the threads of threaded shaft 38. As threaded shaft 38 rotates, arm 36 moves upwardly or downwardly dependent upon the direction of rotation of threaded shaft 38. Bushing 41 provides support for the upper end of threaded shaft 38. Upper pressure plate 44 is secured to arm 36 utilizing nut 47 therefor. Upper pressure plate 44 has its lowermost lateral surface 46 skew or at some angular relationship at all times with the longitudinal axis, as shown by dotted lines 48, of threaded screw 38. Likewise, lowermost lateral surface 46 of upper pressure plate 44 is in a non-parallel relationship with protrusion 26. Frontmost end 49 of uppermost pressure plate 44 is always maintained closer to protrusion 26 than is end 50.

Figure 3:
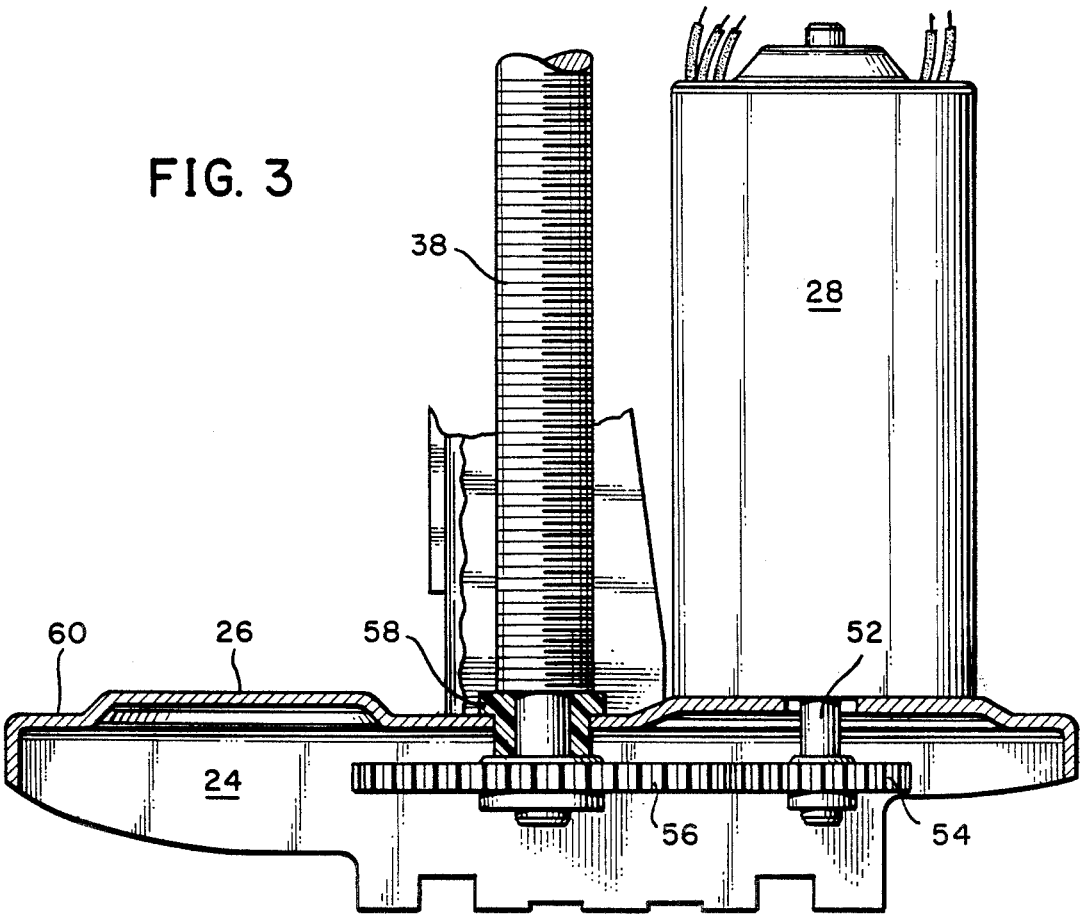
FIG. 3 is a partial cross-sectional view of FIG. 2.

FIG. 3 illustrates base 24 with motor 28 secured to the uppermost surface thereof. Shaft 52 of motor 28 is coupled to gear 54 which in turn is coupled to gear 56. Gear 56, engages the end of threaded shaft 38 in such a manner that they are coaxially aligned and will rotate together. Bushing 58, provides support for the lowermost end of threaded shraft 38. Protrusion 26 is shown above the uppermost lateral surface 60 of base 24. If desired, a bottom cover adapted with rubber-like feet, not shown, may be affixed to the bottom of base 24.

Figure 4:
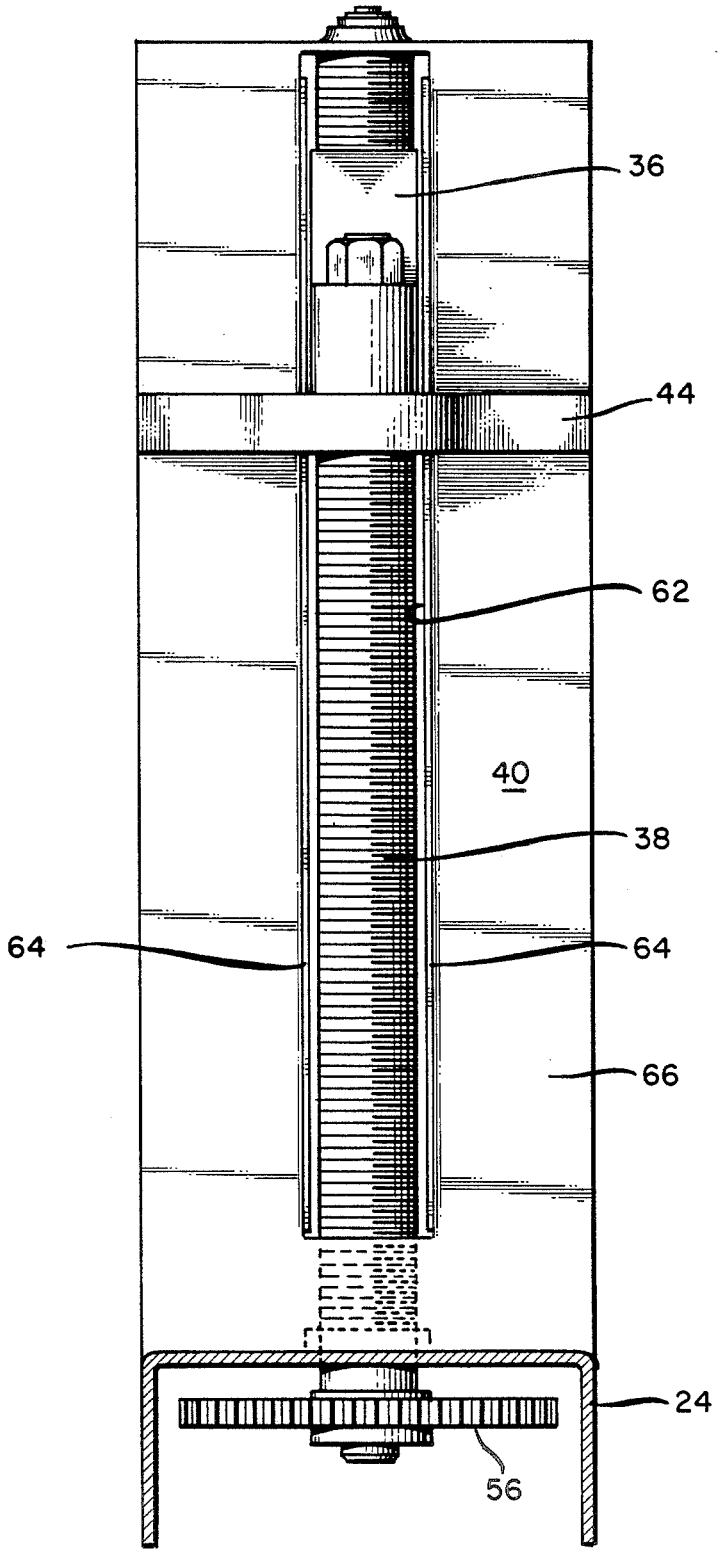
FIG. 4 is a partial cross-sectional view of the apparatus shown in FIG. 2 taken along lines 4—4 viewed in the direction of arrows 4—4.

FIG. 4 illustrates plate 40 having therein an elongated rectangular slot 62. Passing through slot 62 is a portion of arm 36 with threaded shaft 38 shown therebehind. Parallel lips or extensions 64 are shown projecting forwardly from lateral surface 66 of plate 40. Uppermost pressure plate 44 is shown disposed secured to arm 36 and resides forwardly from lateral surface 66. Gear 56 is shown secured within the confines of base 24.

Figure 5:
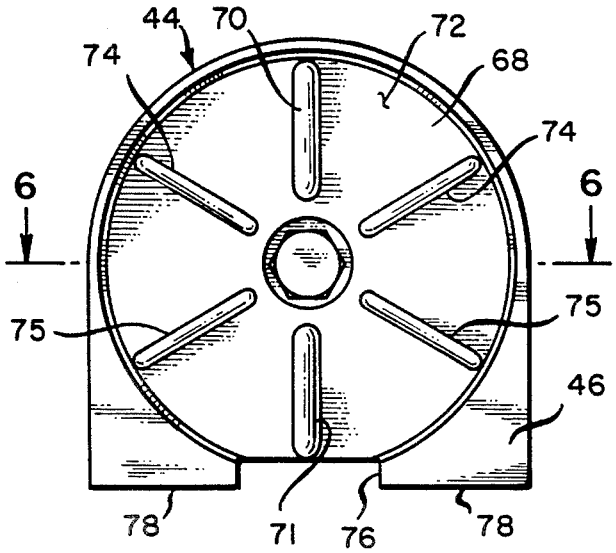
FIG. 5 is a plan view of the underside of a portion of the apparatus shown in FIG. 2.

FIG. 5 illustrates the lowermost lateral surface 46 of upper pressure plate 44. Recess 68 is shown machined from surface 46 and has a circular periphery configured to be able to contain a portion of the uppermost surface of the can to be crushed. Protrusions 70 and 71 are coaxially disposed and extend a greater distance away from floor 72 of recess 68 than pairs of protrusions 74 and 75. Protrusions 70 and 71 and pairs of protrusions 74 and 75 are shown disposed extending radially outwardly from the center of recess 68. Protrusions 74 are disposed approximately 120 degrees apart, one to another, and are adjacent and spaced equidistant from protrusion 70. Likewise, protrusions 75 are adjacent protrusion 71. Protrusions 70 and 71 are somewhat thicker than protrusions 74 and 75. In no event are protrusions 70, 71, 74 and 75 configured to extend outwardly of recess 68. Protrusion 70 is disposed nearest end 49 of uppermost pressure plate 44, shown in FIG. 2, and is the first protrusion to contact the can to be crushed. If desired, base 72 of recess 68 may be maintained in a parallel relationship with protrusion 26, shown in FIG. 2. If this be the case, then protrusion 70 would depend further from base 72 than protrusion 71. Likewise, protrusions 74 may be closer to base 72 of recess 68 with protrusions 75 being configured to have a lower height than protrusions 74. In this manner, protrusion 70, followed by protrusions 71, followed by protrusions 74, and finally followed by protrusions 75, sequentially contact the uppermost lateral surface of the can to be crushed. Alternatively, protrusions 70 and 71 may extend a common height with protrusions 74 and 75 having a somewhat lesser height in the case where base 72 of recess 68 is skew to protrusion 26, shown in FIG. 2. This can be accomplished by the uppermost lateral surface of uppermost pressure plate 44 being parallel to base 72 of recess 68 when uppermost pressure plate 44 is maintained skew to the surface of protrusion 26, shown in FIG. 3. In both cases, protrusions 70 and 71 are coaxially aligned with protrusions 70 and 71 extending radially outwardly from center of recess 68 and protrusions 74 and 75 similarly extending radially outwardly from the center of recess 68. In both such cases, protrusion 70 is located nearest end 49 of uppermost pressure plate 44, as shown in FIG. 2, whilst protrusion 71 is located adjacent end 50 of uppermost pressure plate 44, shown in FIG. 2.

It is apparent that recess 68 as employed captures a portion of the sidewall of the can to be crushed and prevents its tilting despite the fact that forces are applied sequentially and at several points at the rim of the uppermost lateral surface of the can to be crushed at diverse times and locations.

Since no more than two points adjacent to the outside diameter of the uppermost lateral surface of the can to be crushed are initially deformed from their original shape at one time, the size of the motor required for such operations is minimized. In the process of being deformed, for the embodiment shown in FIGS. 5 and 6, the region of the can to be crushed disposed below the protrusion which is deforming the lateral surface of the can uses a concentrated force operating downwardly thereon and causes the side of the can to become bent and manipulated, such that the accordion-like pleating of the sidewall of the can can be neatly accomplished to the can so preweakened.

In the embodiment where the pressure plates have their opposed lateral surfaces skew to one another and where no protrusions are employed on the uppermost pressure plate to deform the lateral surface of the can, can deformation occurs firstly at a point where the uppermost pressure plate first contacts the can. Then, as the uppermost pressure plate descends, two points, running from the first point of contact and extending towards a final point located radially opposite the first point, experience downward forces generated by the uppermost pressure plate. These two points circle about the periphery of the can causing the sides of the can to buckle thereunder, until both points merge at the final point.

Notch 76 has a depth and width to accommdate lips 64 shown in FIG. 4 such that a portion of ends 78 of upper pressure plate 44 are in sliding engagement with surface 66 of plate 40 shown in FIG. 4.

Figure 6:
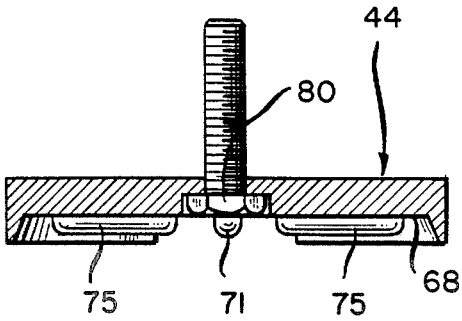
FIG. 6 is a cross-sectional view of the apparatus shown in FIG. 5 taken along lines 6—6 viewed in the direction of the arrows 6—6.

FIG. 6 illustrates recess 68 showing protrusions 71 and 75 therein of upper pressure plate 44. Nut 80, recessed below the base of recess 68, is utilized to secure upper pressure plate 44 to arm 36, as shown in FIG. 2.

It can been seen that there is described a can crusher which quickly and easily crushes cans which have been weakened in the early phase of the can crushing operation by the operation of the same motor. After operating the start switch, while the motor continuously operates, forces are applied in selected portions of the top of the can weakening the can, followed by the can crushing operation which requires no further steps on the part of a user. If a force is applied uniformly to the uppermost region of the can to be crushed then the sides of the can resist the crushing of the can to a great extent. By applying a force to the uppermost lateral surface of the can at one or more points of the uppermost surface of the can to be crushed and then sequentially to other points on the uppermost surface of the can to be crushed, followed by still other points in quick succession, all at the beginning of the can crushing operation, the force that is applied to the uppermost lateral surface of the can to be crushed is transmitted downwardly to selective areas of the cylindrical walls of the can to be crushed, thus concentrating the forces thereon and allowing the can to be crushed with relative ease with a lesser amount of force which reduces the size of the motor required. This method requires a motor of much smaller size to accomplish this purpose and produces cans after being crushed which are near cylindrical in shape. This is accommplished by placing a cylindrical can to be crushed upon the upwardly directed protrusion on the stationary lower pressure plate. On the operation of the starting switch the motor begins to operate, and it rotates the threaded shaft or screw. As the threaded shaft or screw rotates in the initial direction of rotation, the arm which is threadingly engaged to the threaded shaft or screw commences a downward direction, approaching the lowermost pressure plate. Affixed to the free end of the arm is the uppermost pressure plate. The surface of the uppermost pressure plate to which the plurality of protrusions are affixed may be permanently slightly skewed and forms a small angular relationship with the longitudinal axis of the threaded shaft or screw and forms the same angle with the lowermost pressure plate in its fixed horizontal position. Such angular relationship can be five to ten degrees.

When the uppermost pressure plate contacts the uppermost lateral surface of the cylindrical can to be crushed, the uppermost surfaces of the can are captured within the cylindrical sidewalls of a recess formed in the lowermost lateral surface of the uppermost pressure plate. Upon further rotation of the motor the uppermost pressure plate continues to move downwardly. The apparatus is manufactured such that the front end of the uppermost pressure plate located furthest from the motor is permanently skewed downwardly from the rearmost end of the uppermost pressure plate.

In the embodiment where sequential separate points are utilized on the upper lateral surface of the can to be crushed, a first protrusion is situated on the lowermost lateral surface and is adjacent the foremost end of the uppermost pressure plate and firstly contacts the horizontal lateral surface of the can to be crushed. After a small period of time, as the uppermost pressure plate continues its downward travel towards the lowermost stationary pressure plate, another radially aligned protrusion disposed within the recess coaxially aligned with the first mentioned protrusion likewise contacts the uppermost lateral surface of the can, now applying a force on the other side of the horizontal uppermost surface of the can to be crushed. Later, as the uppermost pressure plate continues to move downwardly, shorter protrusions contact the horizontal lateral surface of the can to be crushed thus applying selective forces at diverse times and locations to the top of the can. Finally, when all of the protrusions have caused the uppermost lateral surface of the can to be deformed so as to accommodate all of the protrusions, the base of the recess in the uppermost pressure plate communicates with the balance of the uppermost lateral surface of the weakened can to be crushed and the can crushing operation continues until the uppermost pressure plate reaches its lowermost position.

At the conclusion of the can crushing operation the uppermost pressure plate reaches its lower position at which time a micro switch is operated causing the motor to reverse its direction. Another micro switch detects the uppermost position of the uppermost pressure plate and ceases all motor rotation.

It may be seen that the present apparatus can be used for various size cans, such as ten ounce, twelve ounce, or sixteen ounce containers, who have a common diameter but various heights.

By applying forces sequentially to diverse locations of the uppermost lateral surface of the can, the can is selectively weakened such that the force required to be produced by the motor is far less than if the lowermost lateral surface of the uppermost pressure plate is parallel to the stationary lowermost pressure plate. Furthermore, by providing the uppermost pressure plate in its lowermost regions with radial protrusions of varying heights and locations, further selective weakening of the can takes place at diverse locations and times as the uppermost pressure plate descends. By providing a slight skew relationship between the lateral surface of the uppermost pressure plate relative to the uppermost lateral surface of the lowermost pressure plate in the embodiment where discrete protrusions are employed, sequential and spaced apart application of forces are obtained in such a manner as to be applied firstly to one point on the uppermost lateral surface of the can and then to a point on the same surface radially opposite same, and then to two points nearest the first depression, and finally to two points to the uppermost lateral surface of the can to be crushed, nearest, the second point of force applied to the uppermost surface of the can to be crushed.

In this fashion, the motor is a much smaller size to accomplish the purpose of crushing the can and provides a neat cylindrical crushed can. I have discovered in the application of the present invention that cans can be crushed to approximately one-fifth the height of the uncrushed cans and maintain a near cylindrical relationship in the neatly compacted can without sharp edges and without substantial deformation, as in cans crushed by other means. Not only is there a cost reduction in the motor size, but the gearing can be lighter, the frame and mechanical structure of the apparatus may be lighter, resulting in a more economical apparatus subject to less wear and tear. If desired, the same form of device may be utilized in vending machines as in home appliances. Obviously, when the present invention is utilized in a vending machine, the housing, as shown need not be employed.

It is an advantage of this invention to provide a can crushing apparatus which crushes a can vertically with a minimum amount of desired force which is produced electrically.

It is a further advantage of this invention to provide a can crushing apparatus which crushes a can in one smooth continuous operation without any preliminary separate steps of deforming or slitting the can, thus minimizing the amount of effort required for each crushing operation.

Another advantage is to provide a can crushing apparatus where the can can be disposed within the housing of vending machines or disposed in a separate appliance dedicated specifically for the purpose of crushing cans inexpensively and efficiently.

Still another advantage is to provide an electric can crushing apparatus which is small, compact, and easy enough to use such as to constitute a household appliance of inexpensive cost.

It is yet another advantage of the present invention to provide an apparatus in which the uppermost movable pressure plate moves downward in a continuous smooth motion as it engages the upper lateral surface of the can to be crushed, resulting in a deformation of the can during the initial movement of the uppermost movable pressure plate.

Thus, there is disclosed in the above description and in the drawings, an embodiment of the invention which fully and effectively accomplishes the objects thereof. However, it will become apparent to those skilled in the art, how to make variations and modifications in the instant invention. Therefore, this invention is to be limited, not by the specific disclosure herein, but only by the appending claims.

The embodiment of the invention in which an exclusive privilege or property is claimed are defined as follows:

I claim:

1. A can crusher for compressing a can having a cylindrical side surface and upper lateral surface and lower lateral surface, the can crusher comprising a housing, a stationary lower pressure plate, said stationary lower pressure plate secured to said housing, a movable upper pressure plate, a motor, said motor secured to said housing, said motor having an output shaft, a threaded shaft, said threaded shaft mounted for rotation to said housing, coupling means for rotatably coupling said output shaft of said motor to said threaded shaft whereby said threaded shaft rotates about its longitudinal axis upon the rotation of said output shaft of said motor, an arm, said arm being secured to said upper pressure plate, said arm having a threaded opening therein, said threaded opening threadingly engaged with said threaded shaft, said upper pressure plate and said arm being movable in a vertical direction upon the rotation of said threaded shaft, means to apply forces at diverse times and at diverse locations to said upper lateral surface of said can when said can is resting upon said lower pressure plate upon said upper pressure plate descending downwards towards and coming into contact with said upper lateral surface of said can, said means to apply forces including a plurality of protrusions, said plurality of protrusions secured to the lowermost lateral surface of said upper pressure plate, one of said plurality of protrusions extending radially outwardly from the center of said upper pressure plate and in a direction extending away from said longitudinal axis of said threaded shaft, another of said plurality of protrusions coaxially aligned with said one of said plurality of protrusions and extending between said center of said upper pressure plate and in a direction extending towards said longitudinal axis of said threaded shaft, both said one and said another of said plurality of protrusions having a uniform width and height, the others of said plurality of protrusions having the same width and the same height each being narrower and shallower than said one and said another of said plurality of protrusions, all of said plurality of protrusions having lowermost edges that are smooth and extending parallel to said lowermost lateral surface of said upper pressure plate, said all of said plurality of protrusions extending in an equispaced radial pattern about said center of said upper pressure plate, said upper pressure plate having said lowermost lateral surface being skew to said lowermost pressure plate at all times, one edge of said upper pressure plate being furthestmost from said threaded shaft being closer to said lower pressure plate than the opposed edge of said upper pressure plate.

* * * * *